United States Patent [19]

Takada

[11] Patent Number: 4,733,444

[45] Date of Patent: Mar. 29, 1988

[54] SEAT BELT BUCKLE

[76] Inventor: Juichiro Takada, 3-12-1, Shin-machi, Setagaya-ku, Tokyo, Japan

[21] Appl. No.: 44,046

[22] Filed: Apr. 29, 1987

[30] Foreign Application Priority Data

May 8, 1986 [JP] Japan ..... 61-68284

[51] Int. Cl.[4] ..... A44B 11/26

[52] U.S. Cl. ..... 24/641; 24/645

[58] Field of Search ..... 24/633, 637, 641, 643, 24/644, 645; 297/468; 280/801

[56] References Cited

U.S. PATENT DOCUMENTS

| | | | |
|---|---|---|---|
| 4,182,008 | 1/1980 | Pouget | 24/645 |
| 4,358,879 | 11/1982 | Magyar | 24/641 |
| 4,384,391 | 5/1983 | Lindblad et al. | 24/633 |
| 4,388,749 | 6/1983 | Krautz et al. | 24/643 |
| 4,393,557 | 7/1983 | Schmidt | 24/643 |
| 4,394,792 | 7/1983 | Schmidt | 24/637 |
| 4,454,634 | 6/1984 | Haglund et al. | 24/645 X |
| 4,492,007 | 1/1985 | Tolfsen | 24/637 X |
| 4,550,474 | 11/1985 | Doty et al. | 24/637 X |
| 4,575,907 | 3/1986 | Takada | 24/637 X |
| 4,624,034 | 11/1986 | Ishiguro et al. | 24/641 |

FOREIGN PATENT DOCUMENTS

| | | | |
|---|---|---|---|
| 3344041 | 6/1985 | Fed. Rep. of Germany | 24/633 |
| 2491764 | 4/1982 | France | 24/641 |

*Primary Examiner*—Kenneth J. Dorner
*Assistant Examiner*—James R. Brittain
*Attorney, Agent, or Firm*—Brumbaugh, Graves, Donohue & Raymond

[57] ABSTRACT

A seat belt buckle comprises a pivoted latch plate biased to a latched position and kept in that position by a control member slidably carried on the latch plate and biased to a position in which blocking portions cover notches at the edges of the latch plate. Control projections on the sides of a channel-shaped frame are engaged by the blocking portions in the latched position but accept the notches in the latch plate when the control member is moved by a release button to uncover the notches. Cam surfaces on the frame sides coact with cam follower surfaces on the control member to lift the control member and latch plate when the release button is depressed. Anchor projections on the frame sides are received in the notches in the latch plate in the latched position and transfer loads from the latch plate to the frame.

2 Claims, 4 Drawing Figures

SEAT BELT BUCKLE

BACKGROUND OF THE INVENTION

The present invention relates to a seat belt buckle for a vehicle, such as a car, and more particularly to a buckle that allows the tongue member to be released with a relatively small force but also prevents the occurrence of inertial fall-out at the time of impact.

One type of the seat belt buckle that was widely used in the past has a lever disposed on a buckle main body that is pivoted to release a tongue member sewn to the belt end from the buckle main body. However, buckles of this type were relatively difficult to use when secured to a stalk adjacent a seat. Therefore, seat belt buckles which allow release of the tongue member from the buckle main body by simply depressing by a fingertip a push button exposed on the front surface of the buckle main body have gained widespread application in place of the lever-operated type. In these conventional push-button operated buckles, a latch member equipped with a latch projection for engaging a hole in the tongue member is urged by a spring in an anchoring direction. Therefore, if the force of the spring urging the latch member is reduced in order to reduce the force of operation at the time of release, the anchor force between the tongue member and the latch member is also reduced so that when an abnormal impact acts at the time of a vehicle collision, the latch member undergoes displacement due to the force of inertia, and the tongue member is released from the buckle main body. This phenomenon is generally referred to as "inertial fall-out." If the force of the spring acting on the latch member is increased, on the other hand, in order to prevent inertial fall-out, the necessary force for the release operation increases, and the release of the buckle becomes difficult.

Accordingly, in order to solve the problems of the prior art seat belt buckles of requiring a high releasing force to prevent inertial fall-out at the time of collision, the present inventor has proposed previously a buckle for a seat belt (U.S. Pat. No. 4,575,907, Mar. 18, 1986) in which a control member prevents a latch plate from moving out of a latched position except when a push button is depressed. The control member is slidably carried on the latch plate, and when the release button is not depressed, the latch plate is prevented by the control member from accidentally rotating in a releasing direction due to the force of inertia at the time of collision.

In the buckle of the aforementioned U.S. Pat. No. 4,575,907 extension portions that extend out in both sides from the latch plate are received in pie-shaped holes on both side walls of a channel-shaped frame. Curved projections that extend generally downwardly from the upper edges of the pie-shaped holes are accepted by holes in the extension portions of the latch plate when the latch plate moves to the release position. However, a control member having lateral extension portions for closing the holes in the latch plate is slidably carried adjacent the upper surface of the latch plate. When the release button is not depressed, the holes in the extension portions of the latch plate are blocked off, and the ends of the curved projections in the pie-shaped holes in the frame side walls engage the extension portions of the control member, thereby holding the latch plate in the latching position. When the release button is depressed, it engages and moves the control member to a position in which the extension portions of the control member are clear of the holes in the extension portions of the latch plate, so that the latch plate can move to the release position. The control member is biased by a tension spring coupled between it and the latch plate to the latched position. Compression springs bias the release button into its undepressed position. A compression spring biases the latch plate to its latched position.

The buckle of U.S. Pat. No. 4,575,907 is a very good solution to the inertia fall-out problem and allows the release force to be kept low. On the other hand the extension portions extend out beyond the outer surface of the frame sides, which increases the overall width of the buckle and requires the buckle case to be configured to allow the extension portions to move within it. Moreover, the several springs involve increased costs for parts and for carrying out the assembly steps to install them.

SUMMARY OF THE INVENTION

The present invention is a seat belt buckle that embodies the main components of the buckle of U.S. Pat. No. 4,575,907, as described above, but includes some improvements. The improvements, according to the present invention, comprise a lateral portion along each side of the latch plate, a notch in each such lateral portion, a control projection extending in from each side wall of the frame configured and positioned to be received by the corresponding notch in the latch plate when the latch plate is not in the latched position, and a blocking portion on each side of the control member that closes off the corresponding notch and engages the corresponding control projection to prevent the latch plate from moving out of the latched position when the release button is not depressed. When the release button is depressed, the control member is moved to a position in which the blocking portions are clear of the control projections on the frame sides. A spring interposed between the frame and the release button and control member continuously biases the control member to the blocking position and the release button to the undepressed position. Cam surfaces on the side walls of the frame act on cam follower surfaces on the control plate to move the latch member out of the latched position to the release position when the release button is depressed and thereby moves the control member relative to the cam surfaces.

In a preferred embodiment of the invention, an anchor projection on each side wall of the frame extends into the corresponding notch in the latch plate when the latch plate is in the latched position. Each anchor projection is spaced apart from the corresponding control projection to allow the blocking portion of the control member to be received between the two projections. The anchor projections are engaged by the edges of the notches in the latch plate for transfer of loads from the latch plate to the frame.

For a better understanding of the invention reference may be made to the following description of an exemplary embodiment, taken in conjunction with the accompanying drawings.

DESCRIPTION OF THE EMBODIMENT

Figure 1:
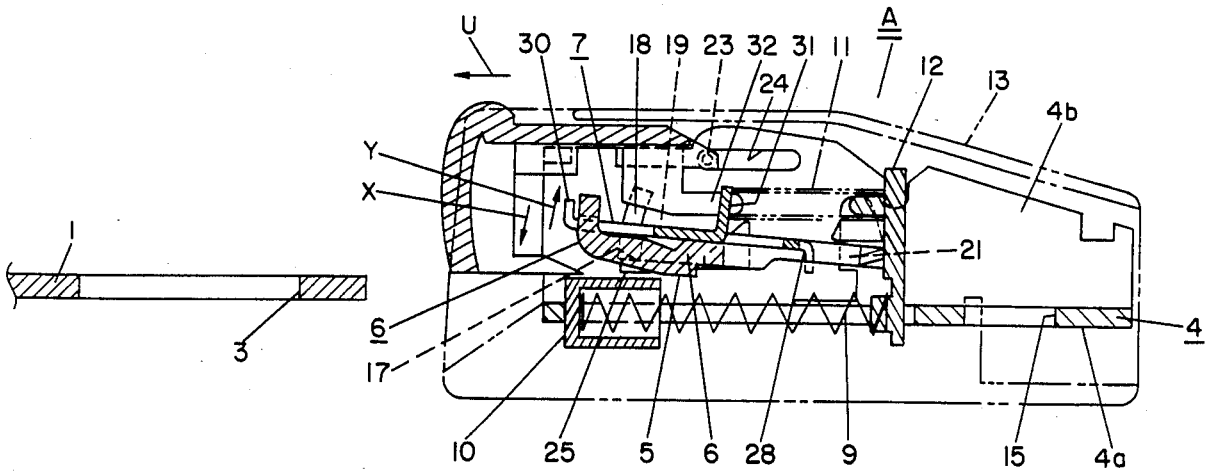
FIG. 1 is a side cross-sectional view of the embodiment showing the components in the positions they assume when the buckle tongue is removed.

In the drawings, reference numeral 1 represents a tongue member. The tongue member has a belt insertion hole 2 at its wide end portion in a customary manner and an anchor hole 3 at the narrow tongue plate portion. Reference numeral 4 represents a channel-shaped frame of a buckle main body A to and from which the narrow tongue plate portion of the tongue member 1 is fitted and removed. The buckle main body A is assembled using the frame 4 as its reinforcing member.

The frame 4 consists of a thick metal sheet formed into a channel cross-sectional shape by bending up side walls **4*b*, 4*c* from a base 4*a*. A latch plate 6, which has a width W a little less than the spacing between the opposed side walls of the frame 4, is supported by the frame 4 in such a manner as to be capable of rocking or pivoting and is equipped with a latch projection 5 that is received in the anchor hole 3 of the tongue member 1. A control member 7 is fitted to the latch plate 6 in such a manner as to be capable of moving relatively with a predetermined stroke distance and limiting the pivoting of the latch plate 6. A release button 8 is received by the frame 4 for movement in the longitudinal direction of the frame. An ejector 10 ejects the tongue member 1 when it is released from the latch plate 6, acting by means of its ejector spring 9. A main spring 11 urges the release button 8 in the returning direction after depression to release the tongue, that is, in the direction represented by arrow u, and also urges the control member 7 in a direction to prevent the latch plate 6 from pivoting out of the latching position (see FIG. 2). A spring-receiving member 12 fitted to the frame supports the fixed ends of the main spring 11 and the ejector spring 9. A cover 13** encloses the latch mechanism.

The base **4*a* of the frame 4 has a guide hole 14, which guides the ejector 10 for movements in the receiving and removing directions of the tongue member 1, and a belt connection hole 15 located to the rear of the guide hole 14. The side walls 4*b* and 4*c* of the frame have the following elements formed on them: integral control projections 18, 18' of such a size and shape as not to interfere with (i.e., so as to be accepted by) notches 17, 17' in lateral extension portions 16, 16' that extend out on both sides of the latch plate 6; cam projections 20, 20' each having an inclined cam surface B engaged by the rear edge of a blocking portion 19, 19' formed integrally on each side of the control member 7; and bent-in latch plate supporting portions 22, 22' supporting rotatably the support shafts 21, 22' at the rear end of the latch plate 6 on both sides. These elements 18, 18', 20, 20' and 22, 22' are disposed sequentially to the rearward from the portion near the tongue receiving end on the inner surface of the respective side walls 4*b*, 4*c* of the frame 4. Moreover, elongated guide holes 24, 24' on the frame 4 above the inclined cams 20, 20' receive guide pins 23, 23' on the rear end side surfaces of the release button 8**.

Reference numerals 25, 25' represent anchor projections on the side walls which mesh with the notches 17, 17' of the latch plate 6 and are engaged by the rearward edges of the notches and transfer the load acting on the latch plate 6 in the belt pulling direction to the frame 4.

The control member 7 is slidably carried on the upper surface of the latch plate 6 and has a recess 26 at its front end and hooks 28 at its rear end. The recess 26 defines front arms that are received under a horizontal arm of a T-shaped guide portion 27 projecting up at the front end of the latch plate 6, and the hooks 28 pass through the hole 29 and engage the lower surface of the latch plate on either side of the hole. The control member 7 moves relative to the latch plate 6 in the tongue inserting and removing directions within a predetermined stroke distance, and the upturned front ends 30, 30' of the horizontal arms on either side of the recess 26 are engaged by the contact portions **8*b* at the back of the front portion 8*a* of the release button 8. An upright arm 31 on the control member 7 is received between bifurcated spring receiving arms 32, 32' at the rear end of the release button 8**.

The buckle having the construction described above will now be described with reference to FIGS. 1 to 3. FIG. 1 shows the idle state before the tongue member 1 is fitted to the buckle main body A. The latch plate 6 has been pivoted in the direction represented by arrow Y with the support shafts 21, 21' being the center of rotation, and the ejector 10 is located underneath the lower surface of the latch projection 5 and prevents the rotation of the latch plate 6 in the direction represented by arrow X under the urging of the spring 11.

In particular, the vertical arm portion 31 of the control member 7 is urged towards the entrance to the tongue receiving space (in the direction represented by arrow u) by the main spring 11, but since the notches 17, 17' of the latch plate 6 accept the curved control projections 18, 18' and since the blocking portions 19, 19' of the control member are in contact with the rear surfaces of the projections 18, 18', the latch plate 6 cannot move in its full forward stroke and is stopped at an intermediate point in the forward stroke.

Figure 2:
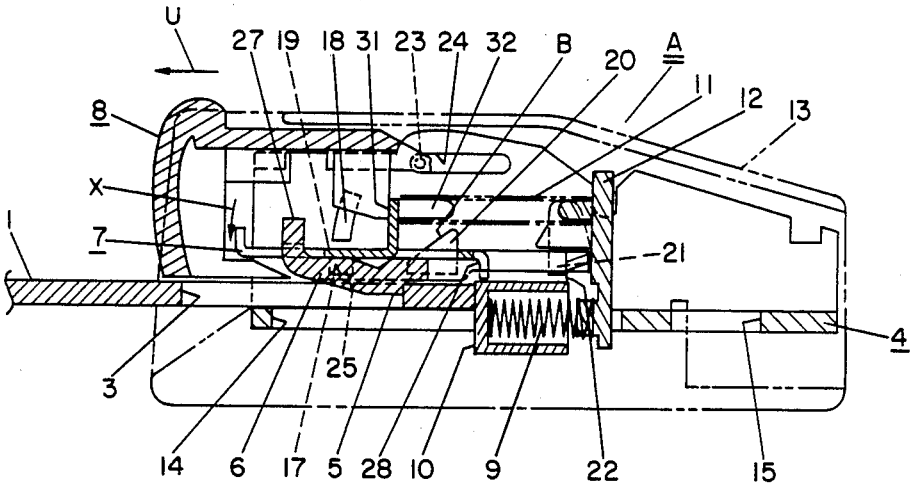
FIG. 2 is a side cross-sectional view of the embodiment showing it with the buckle tongue latched.

When the tongue member 1 is fitted into the buckle main body A as shown in FIG. 2, the ejector 10 is engaged and pushed back by the tip of the tongue member 1 and moves back out from under the lower part of the latch projection 5 so that the latch plate 6 rotates in the direction X with the support shafts 21, 21' being the center of rotation by the action of the main spring 11 and the projection 5 enters the anchor hole 3 of the tongue member 1, thereby connecting the tongue member 1 to the buckle main body A. At this time, the blocking portions 19, 19' of the control member 7 move in the direction u with the forward displacement of the latch plate 6 due to the force of the main spring 11 and prevent the control projections 18, 18' from fitting into the notches 17, 17' of the latch plate 6. Accordingly, even when abnormal impact such as a collision acts upon the latch plate 6, the release of the tongue member 1 from the buckle main body A is prevented because the upper surfaces of the blocking portions 19, 19' and the lower ends of the projections 18, 18' face one another and will engage if the latch plate and control member move in the direction represented by arrow Y.

When a high load is applied to the belt and the tongue member 1 is strongly pulled in the direction represented by arrow u, the load is applied to the latch projection 5 of the latch plate 6 in the same direction. This load is transferred by the engagement between the notches 17, 17' of the latch plate 6 and the anchor projections 25, 25' and thereby transmitted to the frame 4. Therefore, displacement of the support shafts 21, 21' of the latch plate 6 is prevented.

Figure 3:
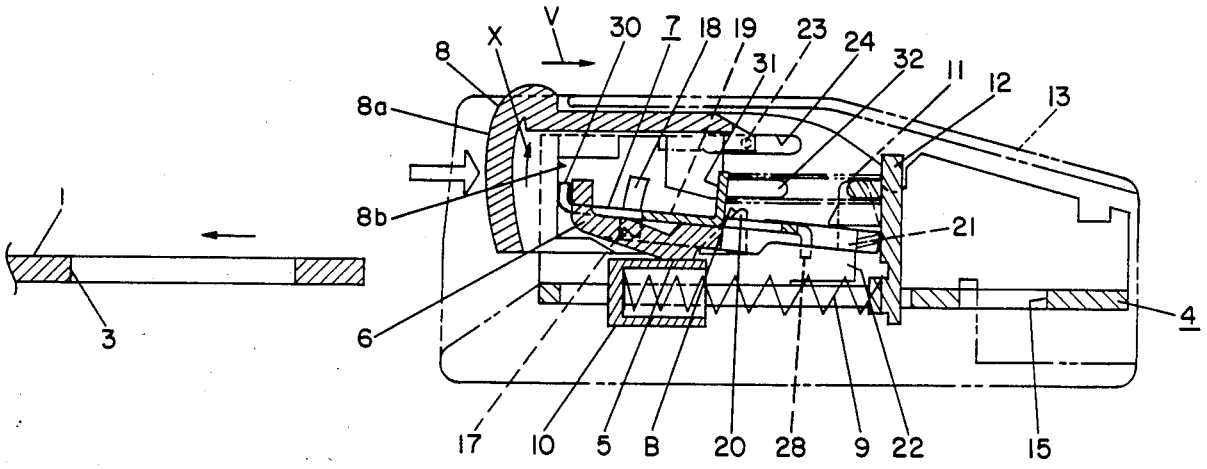
FIG. 3 is a side elevational view showing the embodiment with the release button depressed for release and ejection of the tongue.
Figure 4:
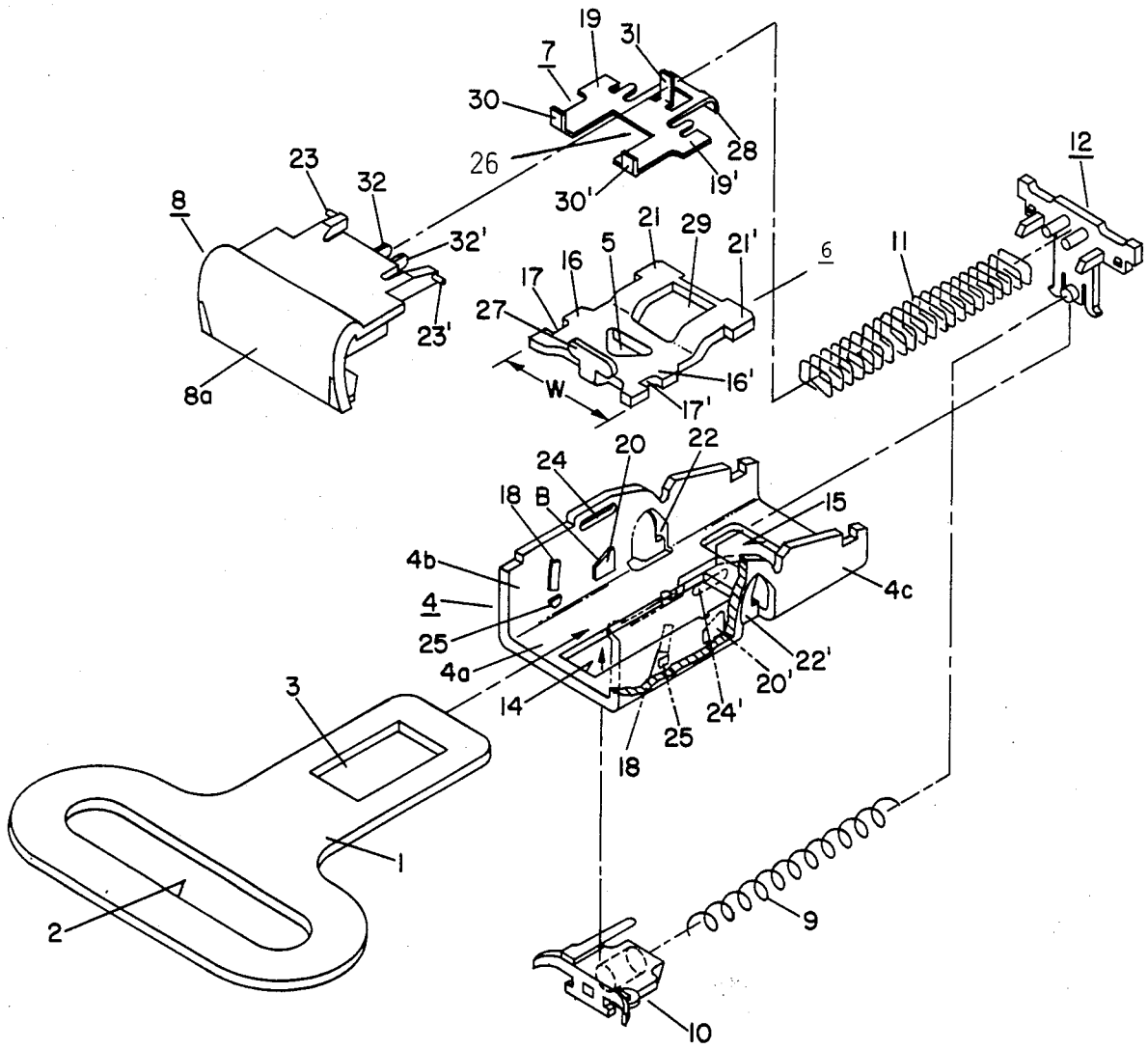
FIG. 4 is an exploded pictorial view of the embodiment.

Next, FIG. 3 shows the state where the tongue member 1 is released from the buckle main body A. First of all, when the release button 8 is depressed in the direction v from the state shown in FIG. 2, the control member 7 is caused to displace in the direction V due to the engagement between the arm portions 30, 30' and the contact portion 8*b*, and the blocking portions 19, 19' are moved back from above the notches 17, 17' of the latch plate 6. Thus, the projections 18, 18' can now enter the notches 17, 17'. When the release button 8 is further depressed, the control member 7 moves further back, and the rear edges of the blocking portions 19, 19' engage with the inclined cam surface B of each cam projection 20, 20'. Therefore, the control member 7 and latch plate 6 pivot conjointly and release the tongue member 1 from the latch projection 5.

At this time, the ejector 10 pushes on the tongue member 1 from the buckle main body A due to the lifting up of the projection 5 and moves forward under the projection 5 to prevent the rotation of the latch plate 6 back to the latched condition. When the release button 8 is released, the ejector 10 engages and moves it to its original full return position as shown in FIG. 1.

I claim:

1. In a seat belt buckle for selectively retaining a buckle tongue in a latched position and having a generally channel-shaped frame that includes a base and a pair of side walls, a latch plate pivotably supported by the frame adjacent one end for movement between a latching position in which a latch projection thereon is received in a hole in the buckle tongue and in which the tongue is confined in a tongue-receiving space defined by the base of the frame and the latch plate, and a release position, in which the latch projection is disengaged from the hole in the buckle tongue, a release button received by the frame for movement substantially parallel to the base of the frame, a control member slidably carried by the latch member and engagable by the release button for movement therewith, the control member and frame having co-acting elements adapted to prevent movement of the latch member out of the latching position when the push button is in a first position and to permit movement of the latch member to the release position when the push button is depressed to a second position, and an ejector member continuously biased to eject the buckle tongue from the receiving space, the improvement wherein the latch plate has a lateral portion along each side located proximate the corresponding side wall of the frame and remote from said one end of the latch plate, wherein each lateral portion has a notch, wherein each side wall of the frame has a control projection configured and positioned to be received by the corresponding notch when the latch plate is not in the latched position, wherein the control member has a blocking portion on each side that closes the corresponding notch and engages the corresponding control projection to prevent the latch plate from moving out of the latched position when the release button is in said first position, each blocking portion being configured and positioned to be clear of the corresponding notch when the release button is depressed to the second position, wherein a spring is interposed between the frame and the release button and control member continuously biassing the control member and release button to the first position thereof, and wherein there are cam means coacting between the control member and the frame for pivoting the control member and latch plate to the release position when the control member is moved in response to movement of the release button to the second position.

2. The improvement according to claim 1 and further comprising an anchor projection on each side of the frame configured and positioned to extend into the corresponding notch on the latch plate when the latch plate is in the latching position, each anchor projection being spaced apart from the corresponding control projection to allow the blocking portion of the control member to be received between said projections.

* * * * *